US007775149B2

(12) United States Patent
Keeney et al.

(10) Patent No.: US 7,775,149 B2
(45) Date of Patent: Aug. 17, 2010

(54) ACTION RATE CONTROL SYSTEM

(75) Inventors: Michael D. Keeney, Rineyville, KY (US); Michael Brent Jarboe, Rineyville, KY (US)

(73) Assignee: RA Brands, L.L.C., Madison, NC (US)

( * ) Notice: Subject to any disclaimer, the term of this patent is extended or adjusted under 35 U.S.C. 154(b) by 831 days.

(21) Appl. No.: 10/973,736

(22) Filed: Oct. 26, 2004

(65) Prior Publication Data

US 2005/0257681 A1 Nov. 24, 2005

Related U.S. Application Data

(60) Provisional application No. 60/516,583, filed on Oct. 31, 2003.

(51) Int. Cl.
*F41A 19/02* (2006.01)

(52) U.S. Cl. ..... 89/129.01; 89/1.7; 42/1.06

(58) Field of Classification Search ..... 89/129.01, 89/1.7; 42/1.06
See application file for complete search history.

(56) References Cited

U.S. PATENT DOCUMENTS

| | | | |
|---|---|---|---|
| 383,372 | A | 5/1888 | Rostel |
| 458,505 | A | 8/1888 | Skoda |
| 449,711 | A | 4/1891 | Skoda |
| 617,110 | A | 1/1899 | Lynch |
| 1,040,001 | A | 10/1912 | Olsson |
| 1,786,207 | A | 12/1930 | Hudson |
| 3,020,807 | A | 4/1958 | Hailston et al. |
| 2,909,101 | A | 10/1959 | Hillberg |

(Continued)

FOREIGN PATENT DOCUMENTS

| | | |
|---|---|---|
| EP | 0 380 041 | 1/1990 |

(Continued)

*Primary Examiner*—Michelle Clement
(74) *Attorney, Agent, or Firm*—D. Scott Sudderth; Womble Caryle Sandridge & Rice, PLLC

(57) ABSTRACT

An action rate control system for a gas operated firearm that includes an action sleeve and an action rate control cylinder. The action sleeve moves in a rearward direction in response to a volume of combustion gases that are generated during firing of the firearm and diverted from the barrel of the firearm through gas ports. The action rate control cylinder is connected to the action sleeve by a linkage that controls movement and slowing of the action sleeve as it approaches a rear limit for its movement. The resistance force generated by the rate control cylinder is a function of the velocity of the action sleeve during its movement. In another aspect, a gas operated firearm includes a barrel, a bolt assembly, an action system coupled to the bolt assembly, and a rate control cylinder coupled to the action system. The action system includes a sleeve assembly that is driven by a volume of combustion gases that are diverted from the barrel when a round of ammunition is fired. The rate control cylinder controls a terminal velocity of the sleeve assembly being driven by the volume of combustion gases. A resistance force generated by the rate control cylinder is a function of the velocity of the bolt assembly during the bolt assembly's rearward movement. The velocity of the bolt assembly follows a controlled and gradual reduction as the energy load associated with the firing is absorbed by the rate control cylinder.

5 Claims, 4 Drawing Sheets

U.S. PATENT DOCUMENTS

| | | | | | |
|---|---|---|---|---|---|
| 2,977,855 | A | | 4/1961 | Catlin et al. | |
| 2,987,967 | A | | 6/1961 | Wild et al. | |
| 3,058,400 | A | | 10/1962 | Hailston et al. | |
| 3,127,812 | A | | 4/1964 | Into et al. | |
| 3,174,401 | A | | 3/1965 | Beretta | |
| 3,200,710 | A | | 8/1965 | Kelly et al. | |
| 3,420,140 | A | | 1/1969 | Beretta | |
| 3,443,477 | A | | 5/1969 | Kaempf | |
| 3,568,564 | A | | 3/1971 | Badali | |
| 3,572,729 | A | | 3/1971 | Hodil, Jr. | |
| 3,601,002 | A | | 8/1971 | Janson | |
| 3,657,960 | A | | 4/1972 | Badali | |
| 3,688,641 | A | * | 9/1972 | Curtis et al. | 89/189 |
| 3,707,110 | A | | 12/1972 | Alday | |
| 3,709,092 | A | | 1/1973 | Tazome | |
| 3,763,742 | A | | 10/1973 | Kotas et al. | |
| 3,799,131 | A | | 3/1974 | Bolton | |
| 3,810,412 | A | | 5/1974 | Zamacola | |
| 3,848,511 | A | | 11/1974 | Zanoni | |
| 3,945,296 | A | | 3/1976 | Hyytinen | |
| 3,968,727 | A | | 7/1976 | Hyytinen | |
| 3,990,348 | A | | 11/1976 | Vesamaa | |
| 4,085,654 | A | | 4/1978 | Panigoni | |
| 4,088,057 | A | * | 5/1978 | Nasypany | 89/1.701 |
| 4,102,243 | A | | 7/1978 | Jennie | |
| 4,125,054 | A | | 11/1978 | Jennie | |
| 4,126,080 | A | * | 11/1978 | Reynolds | 89/199 |
| 4,174,654 | A | | 11/1979 | Liedke | |
| 4,368,590 | A | | 1/1983 | Palmer | |
| 4,373,423 | A | | 2/1983 | Moore | |
| 4,389,920 | A | | 6/1983 | DuFour, Sr. | |
| 4,503,632 | A | * | 3/1985 | Cuevas | 42/1.06 |
| 4,702,146 | A | | 10/1987 | Ikeda et al. | |
| 4,872,392 | A | | 10/1989 | Powers et al. | |
| 4,901,623 | A | | 2/1990 | Lee | |
| 5,218,163 | A | | 6/1993 | Dabrowski | |
| 5,279,202 | A | | 1/1994 | Bellardi | |
| 5,429,034 | A | | 7/1995 | Badali et al. | |
| 5,872,323 | A | | 2/1999 | Norton et al. | |
| 6,227,098 | B1 | * | 5/2001 | Mason | 89/193 |
| 6,508,160 | B2 | | 1/2003 | Beretta | |

FOREIGN PATENT DOCUMENTS

| | | |
|---|---|---|
| EP | 1 102 022 A2 | 5/2001 |
| GB | 483 531 A | 4/1938 |
| GB | 2 072 310 | 9/1981 |

* cited by examiner

ACTION RATE CONTROL SYSTEM

CROSS-REFERENCE TO RELATED APPLICATION

The present patent application is a formalization of a previously filed, provisional patent application entitled "Action Rate Control System", filed Oct. 31, 2003, as U.S. patent application Ser. No. 60/516,583 by the inventors named in this patent application. This patent application claims the benefit of the filing date of the cited provisional patent application according to the statutes and rules governing provisional patent applications, particularly 35 U.S.C. §119(e)(1) and 37 CFR §§1.78(a)(4) and (a)(5). The specification and drawings of the provisional patent application are specifically incorporated herein by reference.

FIELD OF THE INVENTION

The present invention generally relates to firearms, and in particular, to an action rate control system for controlling the action system for a gas operated firearm.

BACKGROUND OF THE INVENTION

"Gas operated" firearms, such as semi-automatic firearms, typically utilize internal bore pressures and/or combustion gases bled from the barrel of the firearm during the firing of a round of ammunition to drive the action system of the firearm. Typically, the action system of the firearm will include an action sleeve assembly or slide that attaches to and communicates with the bolt assembly of the firearm. During operation, upon firing, combustion gases are diverted from the barrel of the firearm to the action system via a series of ports, which are typically cylindrical holes machined in the wall of the barrel. The diverted combustion gases generally force the action sleeve assembly rearward to a stopping point at a rear limit, so that the spent round is ejected; the hammer is moved to a cocked, ready position; and a new round of ammunition loaded into the chamber of the firearm as the action system is closed.

The combined volume of the ports in the barrel regulates the amount of gas and thus the amount of energy that is transmitted to the action system of the firearm. However, a problem exists for firearms that are chambered for cartridges or shot shells, that, within a particular caliber or gauge, can have greatly varying ammunition offerings (i.e., firing magnum loads versus lighter target loads in shotguns, rifles and other types of firearms), such that controlling the energy and/or movement of the action system of the firearm solely by gas port volume is not practical. For example, lighter energy producing loads that result from target loads for shot shells, generally require significantly larger port sizes than higher energy producing loads in order to provide a sufficient volume of gas to drive the action system. Consequently, port geometry in gas operated firearms typically has been set up to accommodate the lightest energy producing loads, i.e., having larger ports, with compensation devices being added to the action system in an attempt to reduce the energy transmission to the action system when higher energy producing ammunition is used.

Compensation devices have typically included spring-loaded pressure relief valves, which are activated upon the operating energy or gas pressure in the system exceeding a predefined pressure, typically provided by the spring, upon which the compensation or pressure relief valve will be opened and a portion of the excess energy/gas bled off or released. Although such compensation systems can reduce input energy (gas pressure), there still remains a substantial difference in the energy available to drive the action system of the firearm. In general, bolt velocity is used as a relative measure of the amount of energy directed to the action system, with the higher the bolt velocity, the more energy that is being directed to the action system.

FIG. 1 generally illustrates a bolt velocity comparison for both high and light energy-producing ammunition rounds in a conventional, compensated, semi-automatic shotgun. As indicated in FIG. 1, there is a significant variation in the peak bolt velocities and in the terminal velocities of the action system in such a conventional compensated firearm for different types of ammunition used. Typically, higher energy-producing rounds, such as magnum rounds, will have a very high peak velocity, e.g., upwards of 400 inches per second. This bolt velocity remains fairly steady through the entire stroke and does not drop off until the bolt is moved to its rear limit and further movement thereof is stopped. Peak velocities for the lighter-producing energy rounds generally are not as high as for the high energy-producing rounds, and are typically only 300 inches per second and tend to remain fairly steady over a longer length of time. In other words, conventional compensation systems typically hit a peak and then remain fairly constant throughout the stroke or cycle of the firearm until it impacts the rear of the receiver and then an abrupt and potentially damaging stop occurs. For both lighter energy-producing rounds and higher energy-producing rounds, the amount of energy put in is limited, but it does not dissipate throughout the stroke.

For semi-automatic firearms, an optimum design would be one that provides consistent bolt velocity profiles regardless of the type of ammunition shot in the firearm, and that will operate with enough energy to ensure a full stroke with a minimum terminal velocity. Upon firing, the velocities at which the action system is translated or moved affects the timing of the various mechanical interactions resulting from operation of the action system, and variations in such velocities can lead to potentially serious malfunctions of the firearm components. Excess terminal velocity can lead to premature fatigue of various components of the firearm, while at full stroke, excess action system energy (velocity), such as generated by high energy rounds, must be consumed or addressed. The consumption of excess energy typically is accomplished through a jarring mechanical impact as the bolt assembly and action system of the firearm are stopped at the rear limit of the action sleeve assembly. Although buffers have been incorporated to soften the impact, the rapid decline in action system velocities still typically will impart substantial inertial loading on the components, potentially causing premature fatigue and failure when higher energy ammunition is shot in large quantities.

Accordingly, it can be seen that a need exists for an action rate control system for a firearm that addresses the foregoing and other related and unrelated problems in the art.

SUMMARY OF THE INVENTION

The present invention is directed to an action rate control system for a gas operated firearm. In an exemplary embodiment, the action rate control system includes an action sleeve and an action rate control cylinder. The action sleeve moves in a rearward direction in response to a volume of combustion gases that are generated during firing of the firearm and diverted from the barrel of the firearm through gas ports. The action rate control cylinder is connected to the action sleeve by a linkage that controls movement and slowing of the action sleeve as it approaches a rear limit for its movement. The resistance force generated by the rate control cylinder is a function of the velocity of the action sleeve during its movement.

In another aspect of the invention, a gas operated firearm includes a barrel, a bolt assembly, an action system coupled to the bolt assembly, and a rate control cylinder coupled to the action system. The action system includes a sleeve assembly that is driven by a volume of combustion gases that are diverted from the barrel when a round of ammunition is fired. The rate control cylinder controls the velocity of the sleeve assembly being driven by the volume of combustion gases. A resistance force generated by the rate control cylinder is a function of the velocity of the bolt assembly during the bolt assembly's rearward movement. The velocity of the bolt assembly follows a controlled and gradual reduction as the energy load associated with the firing is absorbed by the rate control cylinder.

BRIEF DESCRIPTION OF THE DRAWINGS

The invention is better understood by reading the following detailed description of the invention in conjunction with the accompanying drawings.

DESCRIPTION OF THE INVENTION

The following description of the invention is provided as an enabling teaching of the invention in its best, currently known embodiment. Those skilled in the relevant art will recognize that many changes can be made to the embodiments described, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and may even be desirable in certain circumstances and are a part of the present invention. Thus, the following description is provided as illustrative of the principles of the present invention and not in limitation thereof, since the scope of the present invention is defined by the claims.

Figure 5:
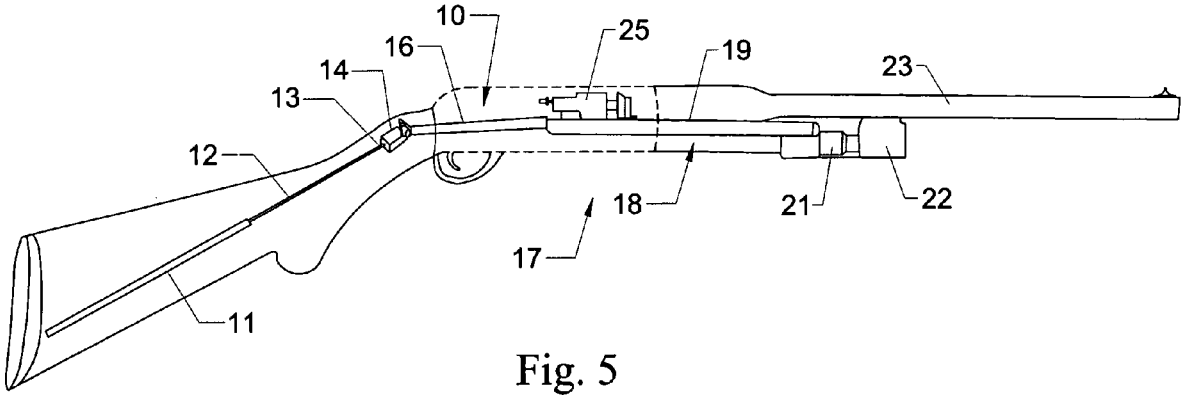
FIG. 5 is a side elevation view of a firearm, with parts broken away for clarity, to illustrate the exemplary rate control system of the present invention in an example environment in a firearm.

The present invention is designed to provide an action rate control system for firearms, and more particularly to gas operated firearms such as semi-automatic rifles, shotguns and handguns. While the present invention is shown in FIG. 5 in one exemplary embodiment in a gas operated auto-loading shotgun, it will be understood by those skilled in the art that rate control system of the present invention also can be adapted for use in various other types of gas operated firearms, including rifles and other long guns, as well as handguns. The present rate control system further is designed to substantially eliminate the requirement for pressure compensation or input energy regulation in gas operated firearms. In addition, the present invention provides a velocity dependent rate control system, such that, regardless of energy input, whether from high energy or low energy rounds of ammunition, bolt velocity can be more consistently controlled to reduce shock and jarring and improve reliability of the function and components of the action system of a firearm.

Figure 3:
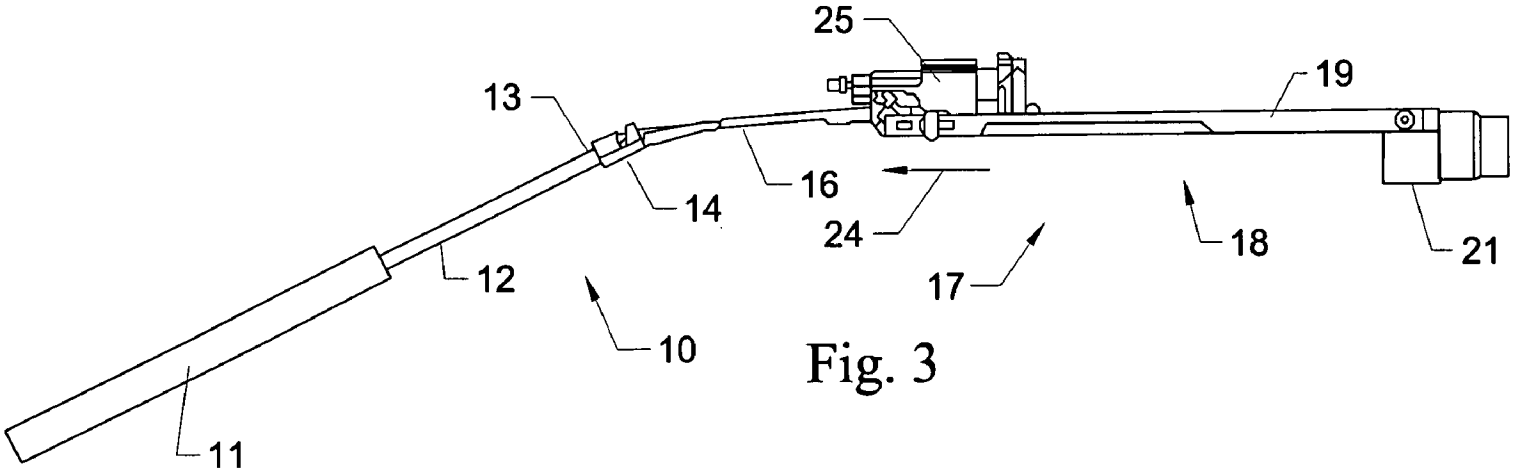
FIG. 3 is a side elevation view schematically illustrating the exemplary rate control system of the present invention.
Figure 4:
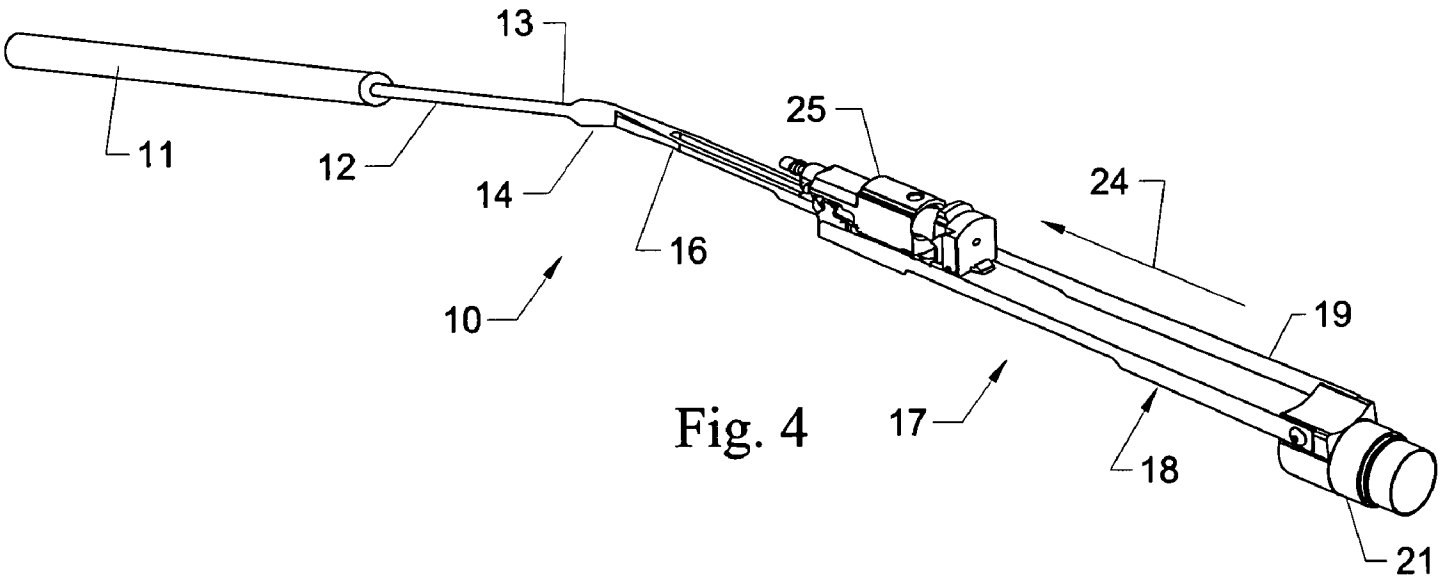
FIG. 4 is a perspective view schematically illustrating the exemplary rate control system of the present invention.

As shown in FIGS. 3-5, the action rate control system 10 of the present invention generally will be mounted in a firearm F (FIG. 5) and will include a rate control cylinder 11 (FIGS. 3-5). The rate control cylinder 11 generally is a hydraulic or pneumatic cylinder, which can be selected to provide a certain minimum or desired level of resistance, or which can be a variable resistance cylinder that can be adjusted as needed. The rate control cylinder 11 generally includes a cylinder rod 12 that is extensible into and out of the rate control cylinder 11 and is attached at its free or distal end 13 to a bearing plate or connector 14. The bearing plate or connector 14 generally is connected to an action sleeve connector or linkage 16, which in turn connects to and is driven by the action system 17 of the firearm. The action system further includes an action sleeve assembly 18 having an action bar or bars 19 that are connected at one end to linkage 16 and at their opposite ends to an action sleeve 21, which generally fits over and slides along the magazine tube (not shown) of the firearm.

The action sleeve 21 is in communication with a gas cylinder 22 of the barrel 23 of the firearm, as indicated in FIG. 5. The firearm barrel 23 will include a series of gas ports or openings formed therein (not shown) so as to divert or direct gases from combustion or ignition/firing of the ammunition toward the sleeve assembly 18. The pressure from these diverted combustion gases causes the action sleeve 21 and action bar(s) 19 to be urged or moved rearward in the direction of arrow 24 (FIGS. 3 and 4) for extraction and ejection of a fired round; cocking of the hammer; stoppage of the action sleeve assembly 18 at a rear termination point or limit; and release and loading of a next round of ammunition from the magazine, which in turn releases the action system 17 to close in preparation to fire the next round of ammunition. At the same time, as the action sleeve assembly is driven rearward, such movement and energy are transmitted to the rate control cylinder 11 of the present invention via the linkage 16. As additionally indicated in FIGS. 3-5, the bolt assembly 25 for the firearm will rest upon and travel with the action system 17 during operation thereof.

As illustrated in FIGS. 3-5, the present invention utilizes a hydraulic rate control system wherein the resistance force generated by the cylinder is proportional to the bolt velocity squared, such that the faster the action sleeve assembly 18 is driven, the higher the resistance force that will be provided by the rate control cylinder 11. Typically, the gas port system (not shown) utilized, will be based on lighter energy-producing loads (i.e., target loads) and thus will include larger gas ports formed in the barrel to accommodate or provide the necessary pressure or gas volume to be bled from the barrel to drive the action system 17 of the firearm for the lightest energy-producing ammunition.

Figure 2:
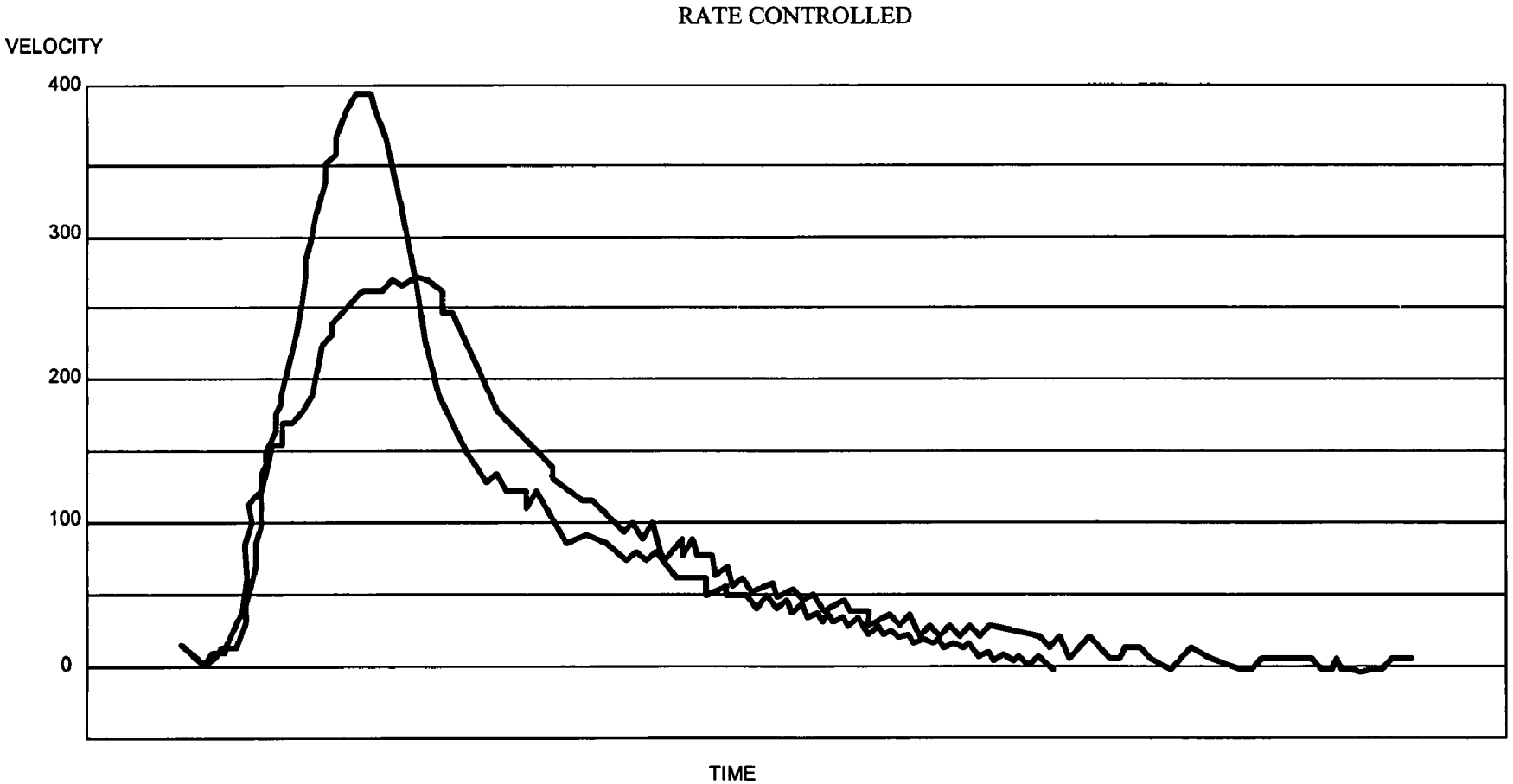
FIG. 2 is a graphical display illustrating bolt velocity comparisons of high and light energy rounds fired on a firearm incorporating the exemplary rate control system of the present invention.

As illustrated in FIG. 2, with the rate control system of the present invention, upon firing, the action system will be forced rearward as combustion gases are diverted from the barrel of the firearm. FIG. 2 further shows a comparison of velocity versus time curves for high energy-producing and low energy-producing rounds fired from a firearm utilizing the rate control system of the present invention. As indicated, for both types of ammunition, immediately upon firing, there will be a large spike in the velocity, whereupon the bolt velocity from the firing of each of the rounds will be at its highest peak. The higher energy-producing round is indicated as having a larger peak or spike in velocity than the lower energy-producing round. However, instead of the sharp drop-off in terminal velocity with conventional compensated firearm systems where the movement of the action system or action sleeve assembly is brought to an abrupt and potentially jarring stop, the excess energy of the action system of the present invention is absorbed and cushioned by the rate control cylinder. As a result, with the present invention, the terminal velocity for both the higher energy-producing (magnum) rounds and lower energy-producing (target) rounds follows a similar controlled pattern that significantly reduces shock to the action system of the firearm and provides more controlled functioning of the action system and bolt assembly components of the firearm to significantly reduce wear and fatigue thereon.

Figure 1:
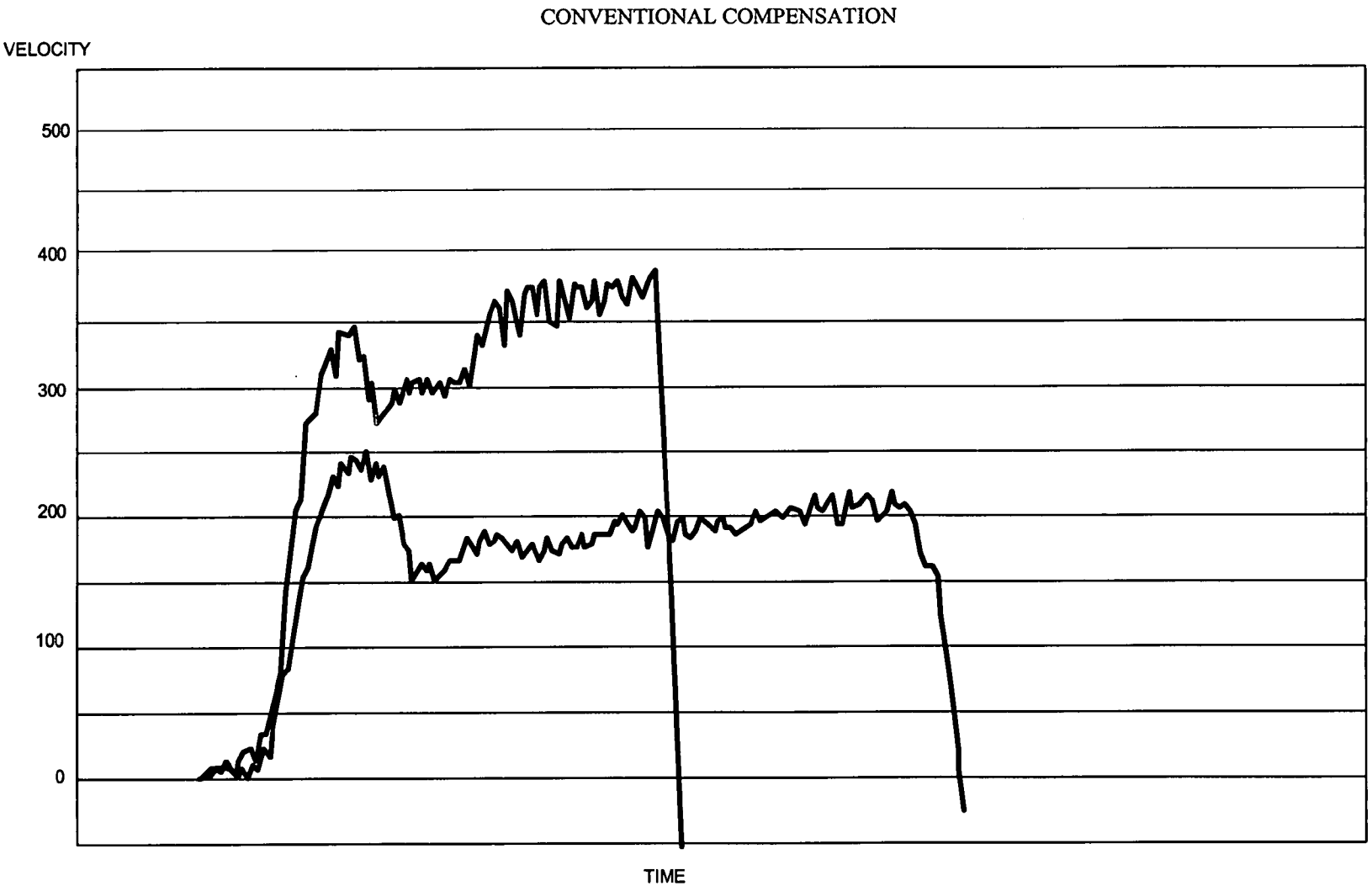
FIG. 1 is a graphical display illustrating comparisons of the bolt velocity over time for high and light energy rounds on a conventional compensated semi-automatic shotgun.

As also indicated in FIG. 2, although higher energy-producing loads produce much higher initial bolt velocities, such bolt velocities generally are rapidly brought down to the terminal bolt velocities generated by lighter energy-producing rounds, and thereafter follow more controlled, consistent and gradually reducing terminal velocities. Accordingly, the use of the rate control system of the present invention establishes a very consistent bolt velocity profile, regardless of the type of ammunition fired, so as to provide a smoother, more controlled mechanical interaction of the firing cycle, such as the cocking of the hammer, stoppage of the action system at its rear limit, release of the next round from the magazine and release of the action system to close in preparation of the next round. In addition, a comparison of the FIG. 1 and FIG. 2 terminal bolt velocities indicates a significant reduction in impact velocity of the bolt assembly and action sleeve assembly at full stroke with the action rate control system of the present invention as compared to conventional compensated systems, thus reducing inertial forces imparted on the action system components, as well as reducing other undesirable effects such as kick of the firearm.

It will be further understood by those skilled in the art that while the foregoing has been disclosed above with respect to preferred embodiments or features, various additions, changes, and modifications can be made to the foregoing invention without departing from the spirit and scope of thereof.

What is claimed is:

1. An action rate control system mounted in a gas operated firearm, the gas operated firearm including a bolt assembly, a barrel, and a gas cylinder affixed to the barrel and receiving combustion gases therein for driving the action rate control system, the action rate control system comprising:

an action sleeve, coupled to the bolt assembly and to the gas cylinder;

a linkage coupled to the action sleeve and extending rearwardly therealong; and a fluid-actuated action rate control cylinder, comprising a hydraulically-actuated cylinder having an extensible cylinder rod projecting therefrom and coupled to the action sleeve by the linkage, for controlling a velocity reduction of the action sleeve as the action sleeve approaches a limit for its movement following a firing of the firearm, wherein upon firing of a round of ammunition by the firearm, the gas cylinder operates to drive the bolt assembly and action sleeve rearwardly at a bolt velocity dependent upon an amount of energy generated by the combustion gases received by the gas cylinder; and wherein the action rate control cylinder is selected to provide a minimum resistance sufficient to control a terminal velocity of the action sleeve being driven by the gas cylinder so as to control velocity reduction of the action sleeve as the action sleeve reaches a rear limit of movement.

2. The action rate control system of claim 1 wherein the action sleeve comprises means for providing an energy load to the rate control cylinder upon firing of the firearm.

3. The action rate control system of claim 1 wherein the rate control cylinder comprises means for generating a resistance force that is a function of a velocity of the action sleeve during its movement.

4. The action rate control system of claim 2 wherein the rate control cylinder comprises means for dissipating the energy load over an entire stroke of the bolt assembly of the firearm.

5. The action rate control system of claim 1 wherein the rate control cylinder comprises an extensible cylinder rod coupled via a bearing plate to the linkage.

* * * * *